US006113848A

United States Patent [19]

Sugimoto et al.

[11] Patent Number: 6,113,848

[45] Date of Patent: Sep. 5, 2000

[54] METHOD FOR FORMING SPIRAL BEVEL GEAR

[75] Inventors: Mamoru Sugimoto; Jiro Tanaka, both of Itami, Japan

[73] Assignee: Sumitomo Electric Industries, Ltd., Osaka, Japan

[21] Appl. No.: 09/141,734

[22] Filed: Aug. 27, 1998

[30] Foreign Application Priority Data

Aug. 28, 1997 [JP] Japan ..... 9-232612

[51] Int. Cl.[7] ..... C22C 33/02

[52] U.S. Cl. ..... 419/68

[58] Field of Search ..... 919/66, 68; 425/78

[56] References Cited

U.S. PATENT DOCUMENTS 3,843,287 10/1974 Fowler .
3,891,367 6/1975 Signora .
3,909,167 9/1975 Signora .
4,050,283 9/1977 Schober .
5,366,363 11/1994 Good et al. .

*Primary Examiner*—Ngoclan Mai
*Attorney, Agent, or Firm*—McDermott, Will & Emery

[57] ABSTRACT

A spiral helical gear having right and left tooth flanks having such a small pitch angle that either right or left ones are not seen in plan from the apex side of cone is molded by a powder molding device so as not to interfere with a die of the device when removed from the die. The die has teeth for molding and is rotatably supported. A fixed guide mechanism for guiding the die is provided. Guide portions of the guide mechanism have a predetermined lead so that the die is rotated guided by the guide portions when the molded article is punched out of the die. Thus, the teeth formed on the molded article reliably disengage from the teeth for molding. This makes it possible to reliably punch the molded article out of the die.

1 Claim, 6 Drawing Sheets

METHOD FOR FORMING SPIRAL BEVEL GEAR

BACKGROUND OF THE INVENTION

This invention relates to a method of forming a spiral bevel gear, more particularly a method which makes it possible to form a spiral bevel gear having a small pitch angle (e.g. 45° or less) by powder metallurgy, and a powder molding device.

Conventional sintered spiral bevel gears molded from powder had a large pitch angle. This is for the following reasons. As shown in FIG. 3, in the case of spiral bevel gears having a pitch angle θ not less than 45°, the entire tooth flanks appear in a plan view as seen from the apex side of the cone of spiral bevel gear, so that compressed molded articles can be punched out of dies without encountering any problem even on an ordinary powder molding device having its upper and lower punches and die nonrotatably supported.

But in the case of a spiral bevel gear having a pitch angle θ<45° as shown in FIG. 4, the left tooth flank LF or right tooth flank RF are hidden as viewed in plan. Thus, if one tries to simply punch a molded article out of the die, the article would not come out because the molded spiral teeth interfere with the mold (having teeth for molding).

Thus, conventional sintered spiral bevel gears made by powder metallurgy were limited to ones having a pitch angle θ>45°, while conventional spiral bevel gears with θ<45° were all made by cutting.

Powder metallurgical method is higher in mass-productivity and lower in the manufacturing cost than cutting method. Thus, it is desired to manufacture spiral bevel gears having tooth flanks not seen in plan by powder metallurgy.

An object of this invention is to provide a method which solves this problem.

SUMMARY OF THE INVENTION

According to this invention, there is provided a method of manufacturing a spiral bevel gear of the type in which at least one of right tooth flanks and left tooth flanks thereof are not seen in plan as viewed from the apex side of the cone of the spiral bevel gear by means of a powder molding device having an upper punch and a lower punch and a die with teeth for molding, the method comprising the step of punching a compression-molded article out of the die while rotating the article relative to the die or the upper punch with a lead L given by the following formula:

$$L_{min}<L<L_{max}$$

$$L_{max}=2\pi/\alpha(r'-r'')\tan(\theta-\theta'')$$

$$L_{min}=2\pi/\beta(r'-r'')\tan(\theta-\theta'')$$

wherein:

α: central angle between A and B of FIG. 5 {A: corner of left tooth flank (which is right tooth flank if the teeth are twisted leftwardly) on the tip circle. B: intersection of the bottom side of the left tooth flank (which is right tooth flank if the teeth are twisted leftwardly) and the tip circle on plan view.}

β: central angle between C and D of FIG. 5 {C: corner of right tooth flank (which is left tooth flank if the teeth are twisted leftwardly) on the tip circle. D: intersection of the bottom side of the right tooth flank (left tooth flank if the teeth are twisted leftwardly) and the tip circle on plan view.} r': radius of the tip circle at the small end face r": radius of the root circle at the small end face θ: pitch cone angle θ": root angle FIG. 5 shows, on an enlarged scale, a portion of the spiral bevel gear of FIG. 4. In FIG. 5, in order to punch out the corner A of the left tooth flank LF on the tip circle S without interfering with the point B on the mold, it is necessary to cause the relative rotation between the molded article (spiral bevel gear) and the molding teeth on the die (not shown) in mesh with the teeth of the molded article by at least angle α while they are relatively moved axially by distance Z (FIG. 4B) relative to each other. The maximum lead $L_{max}$ (FIG. 6) that can create the relative rotation by the angle α is given by the following formula (1).

$$L_{max}=2\pi/\alpha(r'-r'')\tan(\theta-\theta'') \quad (1)$$

On the other hand, if the relative rotation angle is too large, the corner C of the right tooth flank RF on the tip circle would interfere with the mold. Thus, it is necessary to limit the maximum relative rotation angle while the molded article and the molding teeth are axially moved relative to each other by distance Z to a value smaller than the central angle β between B and D. The minimum lead $L_{min}$ (FIG. 6) that creates the rotation by angle β is given by the following formula (2).

$$L_{min}=2\pi/\beta(r'-r'')\tan(\theta-\theta'') \quad (2)$$

Thus, by rotating the molded article and the die with the molding teeth relative to each other with a lead L that satisfy the formula $$2\pi/\beta(r'-r'')\tan(\theta-\theta'')<L<2\pi/\alpha(r'-r'')\tan(\theta-\theta'')$$

it is possible to punch the article out of the die.

The optimum lead $L_{opt}$ (FIG. 6) for relative rotation will be: $\frac{1}{2}(L_{max}+L_{min})$ $$\therefore L_{opt}=\pi(1/\alpha+1/\beta)(r'-r'')\tan(\theta-\theta'')$$

The powder molding device embodying this invention includes a rotatable die having teeth for molding. When a molded article is punched out, the die is rotated with a lead L guided by a fixed guide means. Thus, the molded article can be removed without interfering with the die and without rotating. The molded article can thus be punched out of the die without any damage.

The same effects are expectable with a structure in which an upper punch having teeth for molding is firstly pulled out of the die guided by a fixed guide means while rotating with a lead L, and then the molded article is punched out of the die by pushing it up with a lower die. But this structure has a problem in that a twisting force is applied to the molded article during compression molding while the upper punch is pushed into the die while rotating with a lead L. The device in which not the upper punch but the die is rotated is free of this problem, and thus the molding is more stable.

Other features and objects of the present invention will become apparent from the following description made with reference to the accompanying drawings, in which:

DETAILED DESCRIPTION OF THE PREFERRED EMBODIMENT

Figure 1:
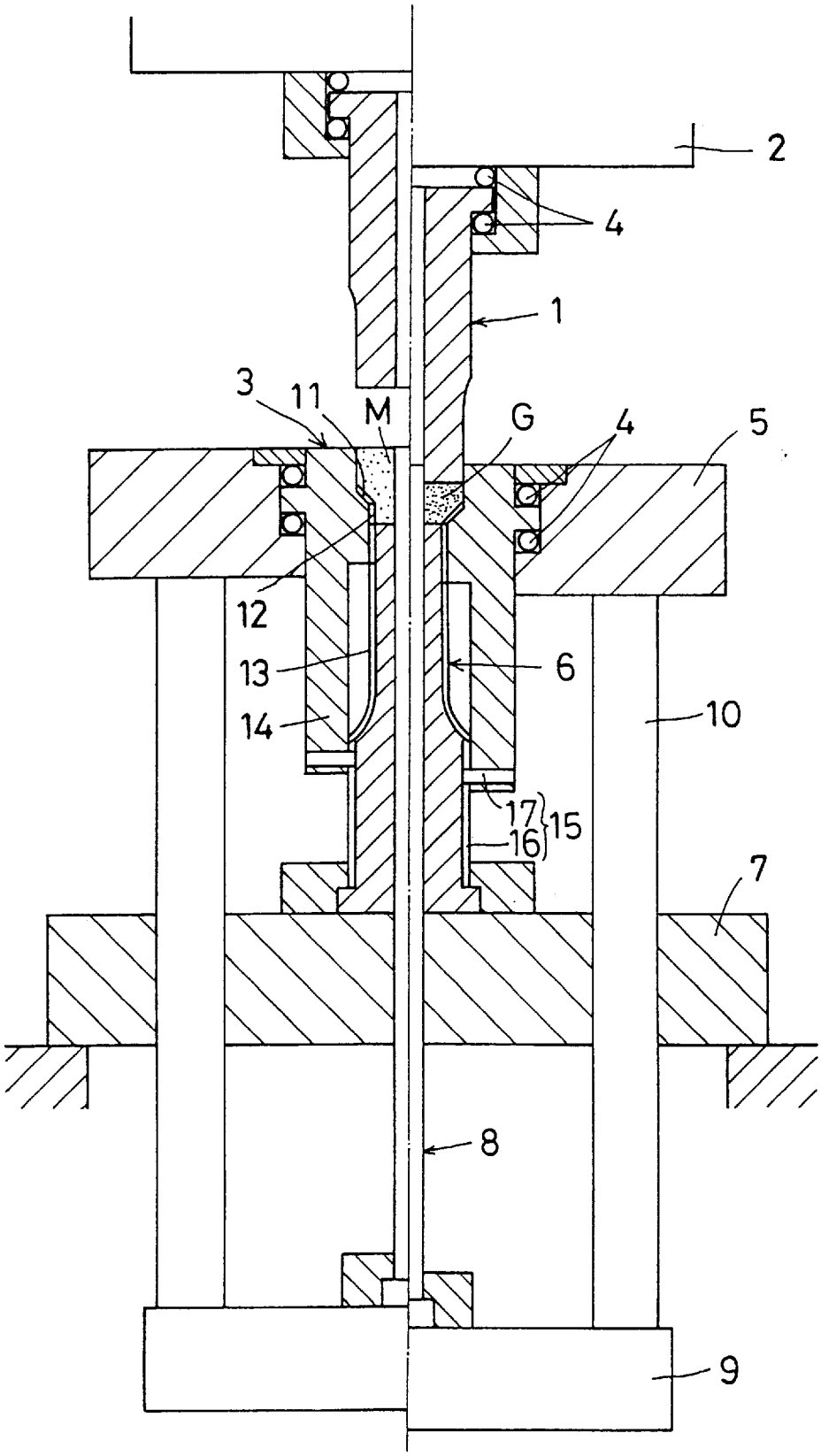
FIG. 1 is a sectional view of a powder molding device embodying this invention.

FIG. 1 shows a powder molding device embodying this invention. The left half of the figure shows a state when powder has just been supplied, while the right half portion shows a state when the powder has been compressed.

As shown, an upper punch 1 is mounted to an upper plate 2. A die 3 is rotatably mounted on a die plate 5 through bearings 4. A lower punch 6 is secured on a base plate 7. A core rod 8 is fixed to a yoke plate 9.

The upper plate 2 is driven by an upper ram (not shown). The yoke plate 9 is driven by a lower ram (not shown either).

The die plate 5 and the yoke plate 9 are connected together by coupling rods 10 slidably inserted through the base plate 7. Thus, the die 3 and the core rod 8 rise and lower together.

The die 3 has molding teeth (spiral bevel teeth) 11 and helical teeth 12 having a lead L and connecting with the inner ends of the teeth 11. Helical teeth 13 having the lead L are formed on the outer periphery of the lower punch 6 at its upper portion so as to mesh with the helical teeth 12 of the die 3. The lead L is given by the formula shown above.

The helical teeth 12, 13 can serve as a fixed guide means for rotating and guiding the die 3. But the helical teeth 12, 13 are also needed to receive the entire small-diameter side end of the molded article including the molded tooth end on the lower punch 6 and push it up. Thus, in this embodiment, the teeth 12, 13 are used to push up the entire surface. The die 3 is thus guided by a separate fixed guide means 15.

The fixed guide means 15 comprises guide portions 16 provided on the outer periphery of the lower punch 6 and having a lead L (the guide portions shown are guide grooves but they may be ribs instead), and cam followers 17 mounted on a downwardly extending portion 14 of the die 3. The cam followers 17 shown are pins slidably engaged in cam faces of the guide portions 16.

The guide portions 16 and the cam followers 17 may be provided on the downward extending portion 14 of the die 3 and the lower punch 6, respectively. In this embodiment, the lower punch 6 is used as a fixing member. But the guide portions 16 having the lead L or the cam followers 17 may be provided on a cylindrical member fixed on the base plate 7 around the lower punch 6.

Further, if the fixed guide means 15 is provided as shown in the figure, a lower punch 6 having a cylindrical top portion having substantially the same diameter as the root circle of the molded article G may be used with the helical teeth 12, 13 omitted.

With the progression of compression of the powder material M, rotation force acts on the molded article G due to the effect of the lead of the molding teeth 11. Thus, preferably, the upper punch 1 is rotatably supported as shown in FIG. 1 so that it can follow the rotation of the molded article G.

In operation, powder material M is supplied into the cavity defined by the upper punch 1 and lower punch 6, die 3 and core rod 8, and the upper punch 1 is pushed into the die 3 by the upper ram to compress and mold the powder.

During compression molding, the die 3 lowers spontaneously. When the inner ends of the molding teeth 11 descend to the same level as the top surface of the lower punch 6, the compression step is complete and the molded article is formed.

Figure 2:
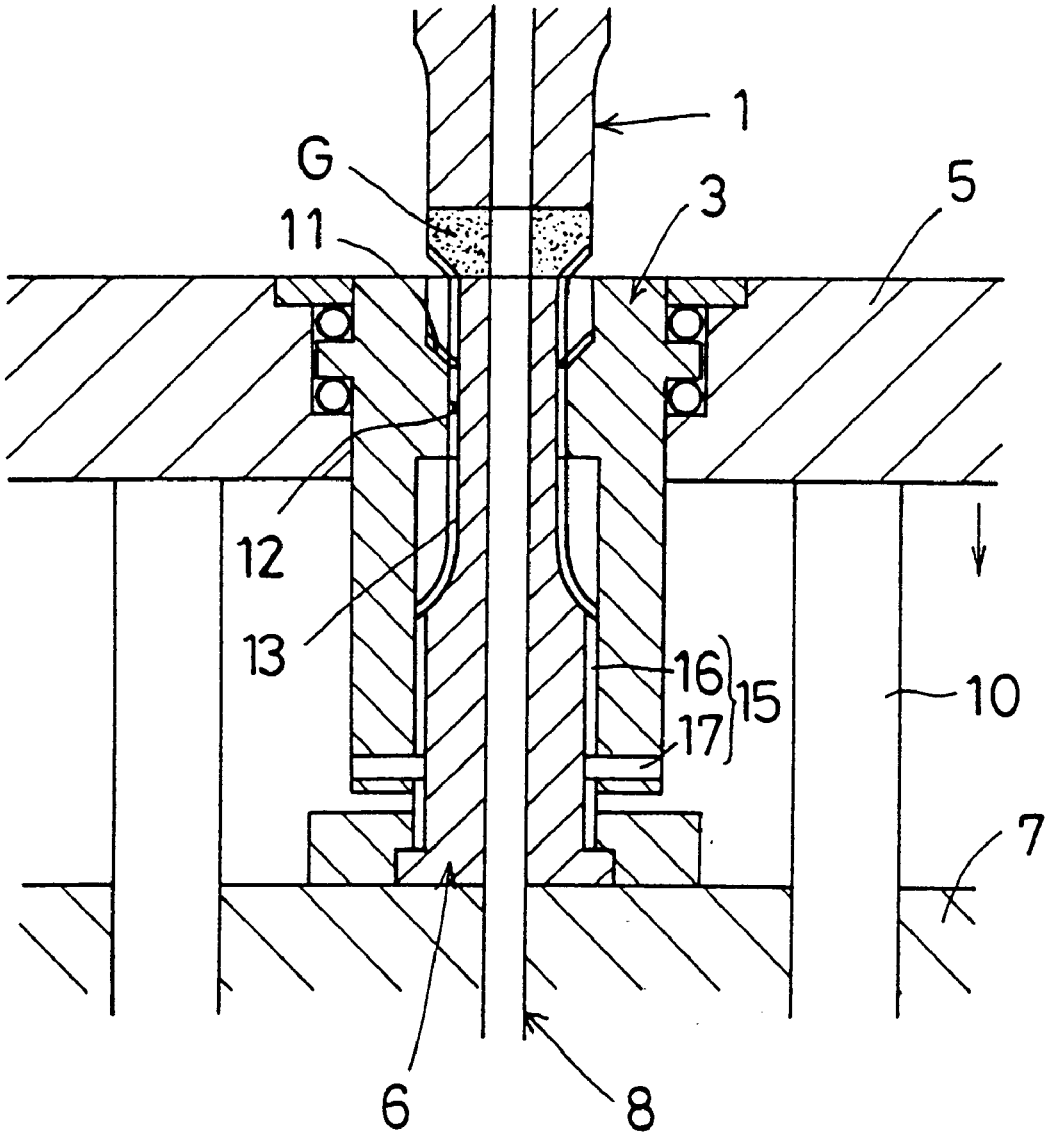
FIG. 2 is a sectional view of the device of FIG. 1 showing how the molded article is punched out.
Figure 3A:
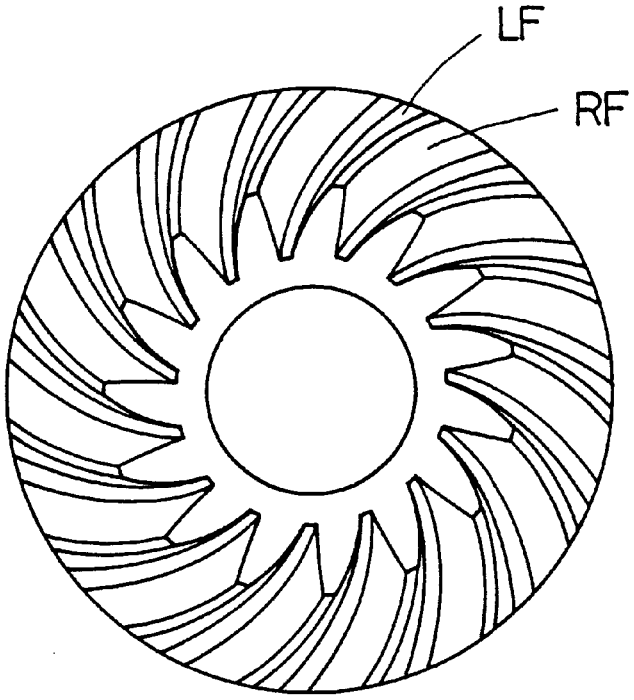
FIG. 3A is a plan view of a spiral bevel gear having right and left tooth flanks, both of which can be seen in plan as viewed from the apex side of the cone.
Figure 3B:
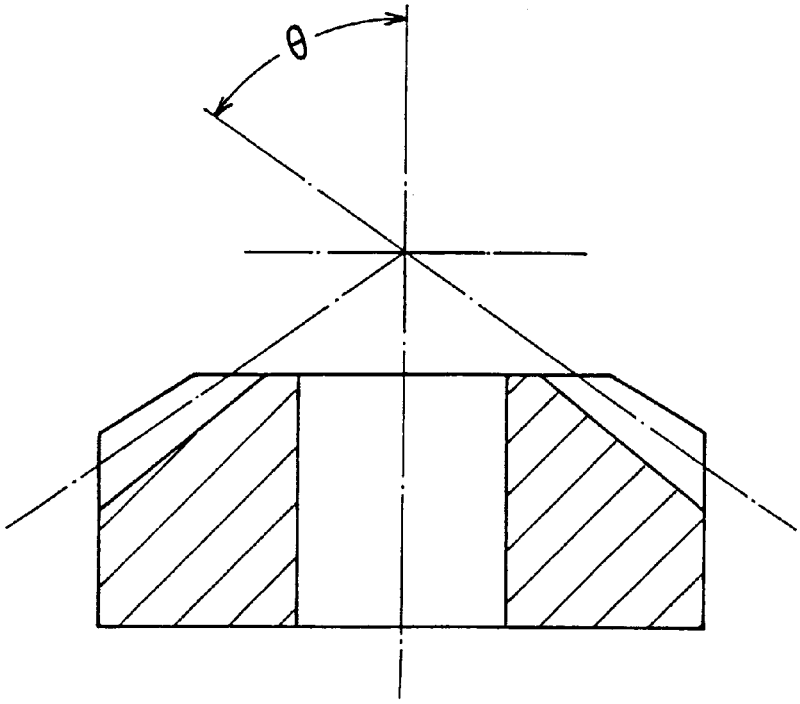
FIG. 3B is a sectional view of the gear of FIG. 3A.
Figure 4A:
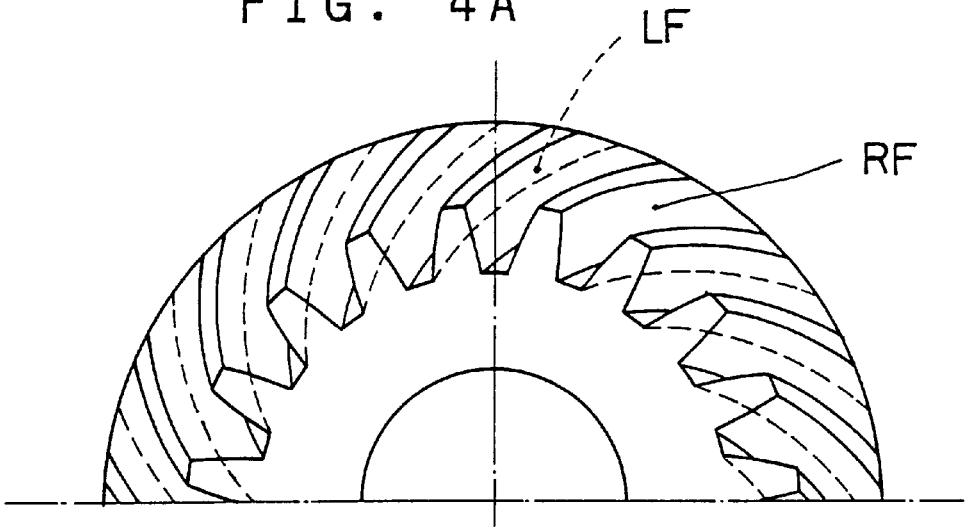
FIG. 4A is a plan view of a spiral bevel gear having right and left tooth flanks, at least one of which are hidden as viewed in plan from the apex side of the cone.
Figure 4B:
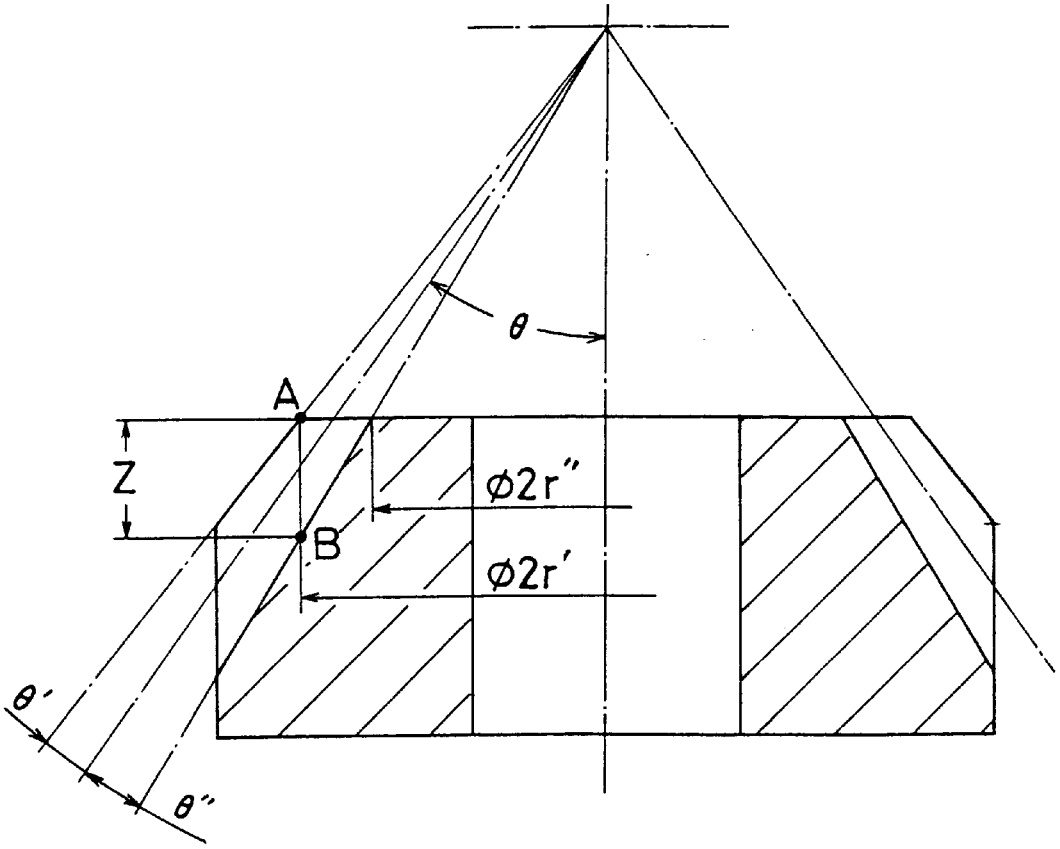
FIG. 4B is a sectional view of the gear of FIG. 4A.

Then, the lower ram is activated to forcibly lower the die 3 and the core rod 8 from the compression completion point. At this time, the die 3 rotates with the lead L while being guided by the guide portions 16. Thus, the molded article G can be pulled out of the die 3 without interferring with the die 3 and without rotating, as shown in FIG. 2. Thereafter, the upper punch 1 is returned to the original position, the molded article is taken out, and the die 3 and the core rod 8 are moved back to their respective original positions. This cycle is repeated.

According to this invention, while the molded article is being punched out, either the molded article and the die with the molding teeth or the die and the upper punch are rotated relative to each other with a predetermined lead. This makes it possible to stably punch out for even a spiral bevel gear with such a small pitch angle that the right or left flank tooth flanks do not appear in a plan view as seen from the apex side of the cone, and thus to mass-produce this type of gears by powder metallurgy which is economically advantageous.

Figure 5:
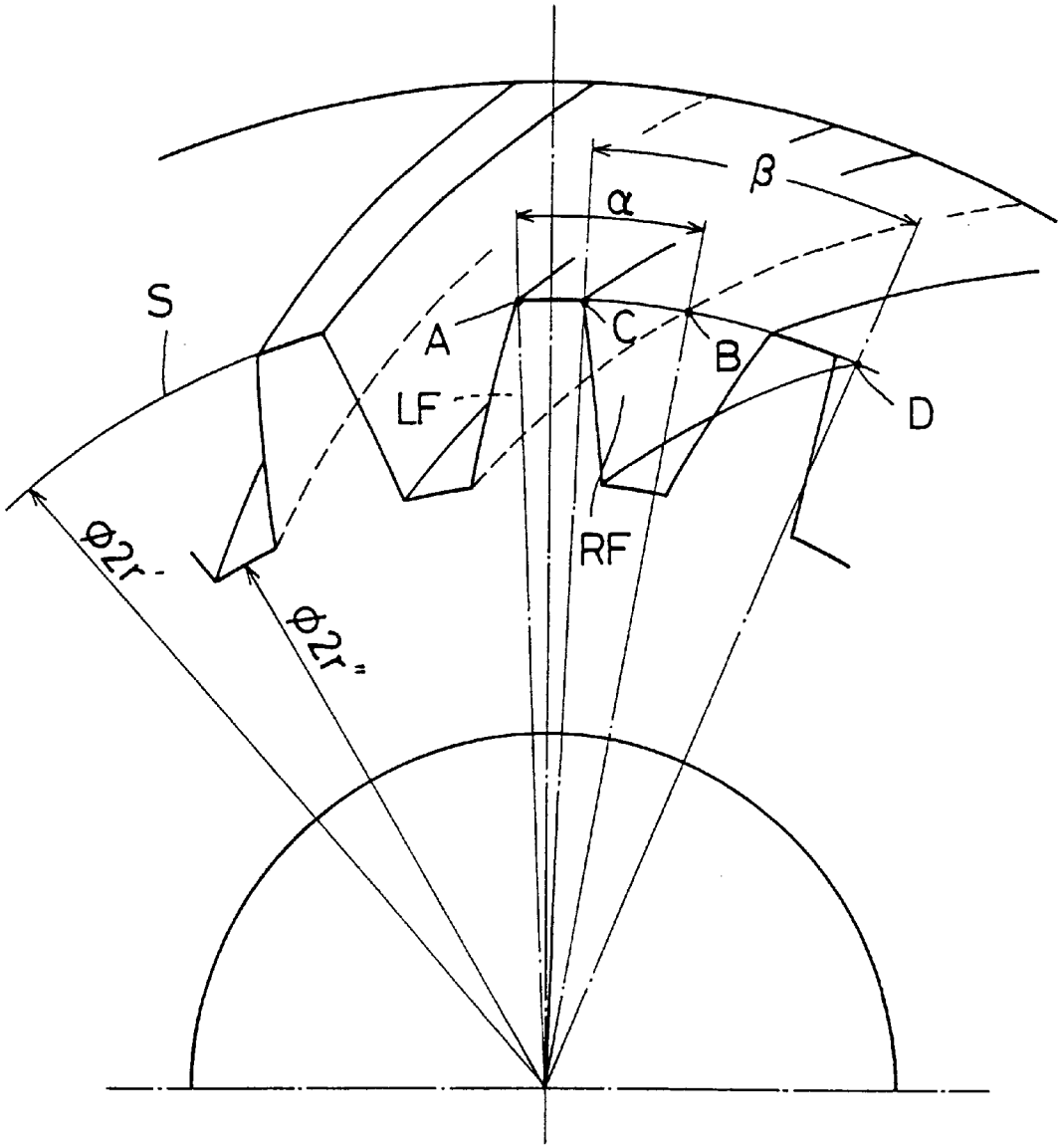
FIG. 5 is a partial enlarged plan view of the gear of FIG. 4.
Figure 6:
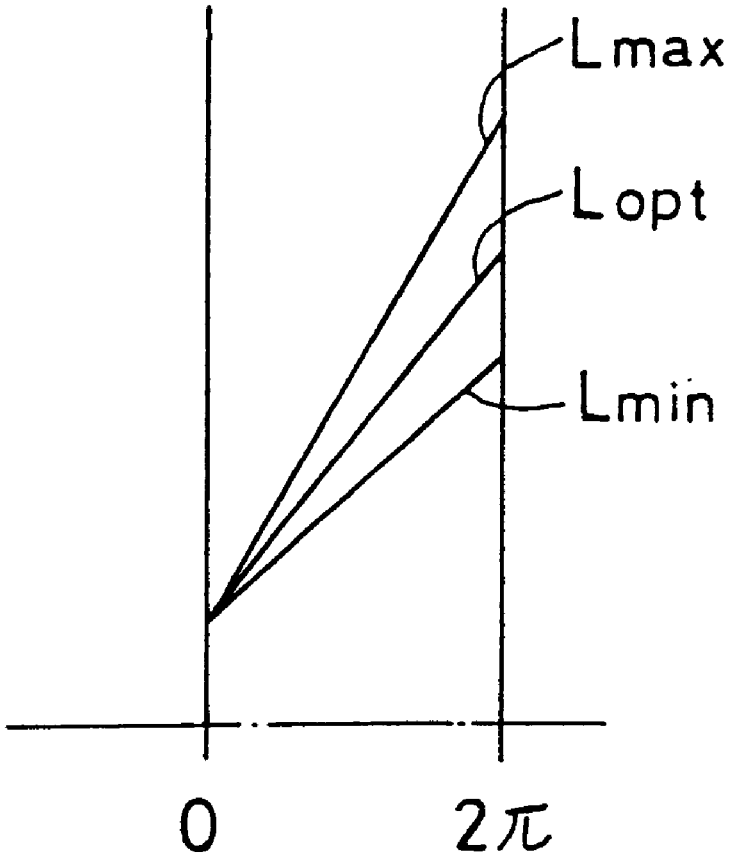
FIG. 6 is a graph showing the limit lead and the optimum lead for relative rotation.

What is claimed is:

1. A method of manufacturing a spiral bevel gear of the type in which at least one of right tooth flanks and left tooth flanks thereof are not seen in plan as viewed from the apex side of the cone of the spiral bevel gear by means of a powder molding device having an upper punch and a lower punch and a die with teeth for molding, said method comprising punch a compression-molded article out of said die while rotating said article relative to said die or said upper punch with a lead L given by the following formula:

$$2\pi/\beta(r'-r'')\tan(\theta-\theta'')<L<2\pi/\alpha(r'-r'')\tan(\theta-\theta'')$$

wherein:

α: central angle between A and B of FIG. 5 {A: corner of left tooth flank (which is right tooth flank if the teeth are twisted leftwardly) on the tip circle; B: intersection of the bottom side of the left tooth flank (which is right tooth flank if the teeth are twisted leftwardly) and the tip circle on plan view}

β: central angle between C and D of FIG. 5 {C: corner of right tooth flank (which is left tooth flank if the teeth are twisted leftwardly) on the tip circle; D: intersection of the bottom side of the right tooth flank (left tooth flank if the teeth are twisted leftwardly) and the tip circle on plan view} r': radius of the tip circle at the small end face r": radius of the root circle at the small end face θ: pitch cone angle θ": root angle.

* * * * *